US006105585A

United States Patent [19]

Thomas

[11] Patent Number: 6,105,585

[45] Date of Patent: Aug. 22, 2000

[54] COMBINATION EYELASH CURLER AND EYELINER APPLICATOR

[76] Inventor: Marsha Thomas, 193 Lake Ct., Crystal Lake, Ill. 60014

[21] Appl. No.: 09/480,516

[22] Filed: Jan. 7, 2000

[51] Int. Cl.[7] ..... A45D 2/48; A45D 40/30

[52] U.S. Cl. ..... 132/217; 132/216

[58] Field of Search ..... 132/217, 216, 132/285, 319

[56] References Cited

U.S. PATENT DOCUMENTS 3,516,423 6/1970 Seidler ..... 132/216
4,784,165 11/1988 Stein ..... 132/217

FOREIGN PATENT DOCUMENTS 638806 6/1950 United Kingdom ..... 132/217

*Primary Examiner*—John J. Wilson
*Assistant Examiner*—Robyn Kieu Doan

[57] ABSTRACT

A combination eyelash curler and eyeliner applicator for curling eyelashes and applying eyeliner simultaneously. The combination eyelash curler and eyeliner applicator includes an eyelash curler having an upper applicator portion, a plurality of replaceable eyeliner cartridges that are attachable to the upper applicator portion of the eyelash curler and a case having a plurality of cavities containing cartridges of different color eyeliner.

7 Claims, 2 Drawing Sheets

COMBINATION EYELASH CURLER AND EYELINER APPLICATOR

BACKGROUND OF THE INVENTION

1. Field of the Invention

The present invention relates to eyelash curlers and eyeliner applicators and more particularly pertains to a new combination eyelash curler and eyeliner applicator for curling eyelashes and applying eyeliner simultaneously.

2. Description of the Prior Art

The use of eyelash curlers and eyeliner applicators is known in the prior art. More specifically, eyelash curlers and eyeliner applicators heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,795,482; U.S. Pat. No. 2,323,595; U.S. Pat. No. 5,176,156; U.S. Pat. No. 5,598,858; U.S. Pat. No. 4,458,701; and U.S. Pat. No. 328,504.

While these devices fulfill their respective, particular objectives and requirements, the aforementioned patents do not disclose a new combination eyelash curler and eyeliner applicator. The inventive device includes an eyelash curler having an upper applicator portion, a plurality of replaceable eyeliner cartridges that are attachable to the upper applicator portion of the eyelash curler and a case having a plurality of cavities containing eyeliner cartridges with different color eyeliner.

In these respects, the combination eyelash curler and eyeliner applicator according to the present invention substantially departs from the conventional concepts and designs of the prior art, and in so doing provides an apparatus primarily developed for the purpose of curling eyelashes and applying eyeliner simultaneously.

SUMMARY OF THE INVENTION

In view of the foregoing disadvantages inherent in the known types of eyelash curlers and eyeliner applicators now present in the prior art, the present invention provides a new combination eyelash curler and eyeliner applicator construction wherein the same can be utilized for curling eyelashes and applying eyeliner simultaneously.

The general purpose of the present invention, which will be described subsequently in greater detail, is to provide a new combination eyelash curler and eyeliner applicator apparatus and method which has many of the advantages of the eyelash curlers and eyeliner applicators mentioned heretofore and many novel features that result in a new combination eyelash curler and eyeliner applicator which is not anticipated, rendered obvious, suggested, or even implied by any of the prior art eyelash curlers and eyeliner applicators, either alone or in any combination thereof.

To attain this, the present invention generally comprises an eyelash curler having an upper applicator portion, a plurality of replaceable eyeliner cartridges that are attachable to the upper applicator portion of the eyelash curler and a case having a plurality of cavities containing eyeliner cartridges with different color eyeliner.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination eyelash curler and eyeliner applicator apparatus and method which has many of the advantages of the eyelash curlers and eyeliner applicators mentioned heretofore and many novel features that result in a new combination eyelash curler and eyeliner applicator which is not anticipated, rendered obvious, suggested, or even implied by any of the prior art eyelash curlers and eyeliner applicators, either alone or in any combination thereof.

It is another object of the present invention to provide a new combination eyelash curler and eyeliner applicator that may be easily and efficiently manufactured and marketed.

It is a further object of the present invention to provide a new combination eyelash curler and eyeliner applicator that is of a durable and reliable construction.

An even further object of the present invention is to provide a new combination eyelash curler and eyeliner applicator which is susceptible of a low cost of manufacture with regard to both materials and labor, and which accordingly is then susceptible of low prices of sale to the consuming public, thereby making such combination eyelash curler and eyeliner applicator economically available to the buying public.

Still yet another object of the present invention is to provide new combination eyelash curler and eyeliner applicator that provides in the apparatuses and methods of the prior art some of the advantages thereof, while simultaneously overcoming some of the disadvantages normally associated therewith.

Still another object of the present invention is to provide a new combination eyelash curler and eyeliner applicator for curling eyelashes and applying eyeliner simultaneously.

Yet another object of the present invention is to provide a new combination eyelash curler and eyeliner applicator which includes an eyelash curler having an upper applicator portion, a plurality of replaceable eyeliner cartridges that are attachable to the upper applicator portion of the eyelash curler and a case having a plurality of cavities containing eyeliner cartridges with different color eyeliner.

Still yet another object of the present invention is to provide a new combination eyelash curler and eyeliner applicator that provides several colors of eyeliner.

Even still another object of the present invention is to provide a new combination eyelash curler and eyeliner applicator that is quick and efficient to use.

These together with other objects of the invention, along with the various features of novelty that characterize the invention, are pointed out with particularity in the claims annexed to and forming part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
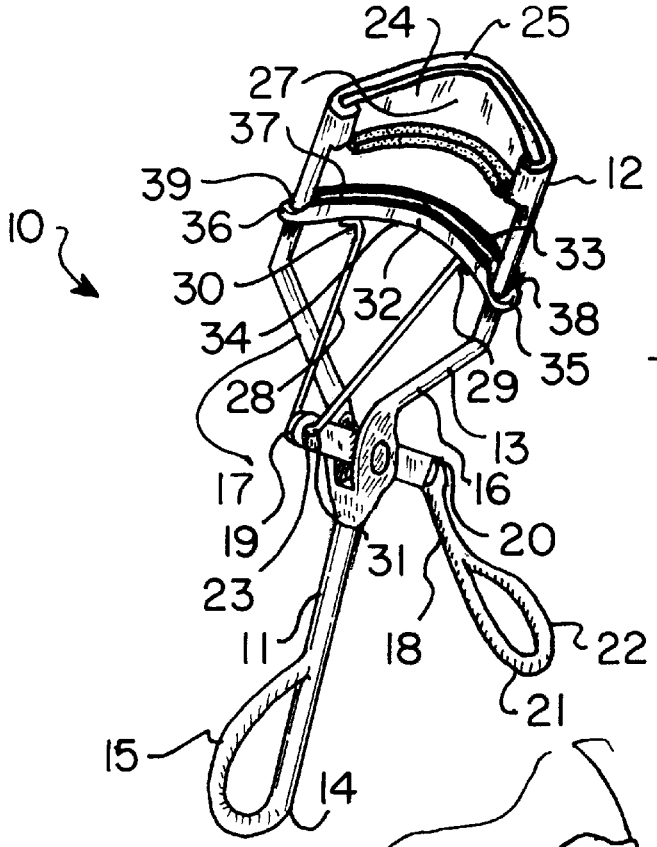
FIG. 1 is a schematic perspective view of a new combination eyelash curler and eyeliner applicator according to the present invention.
Figure 2:
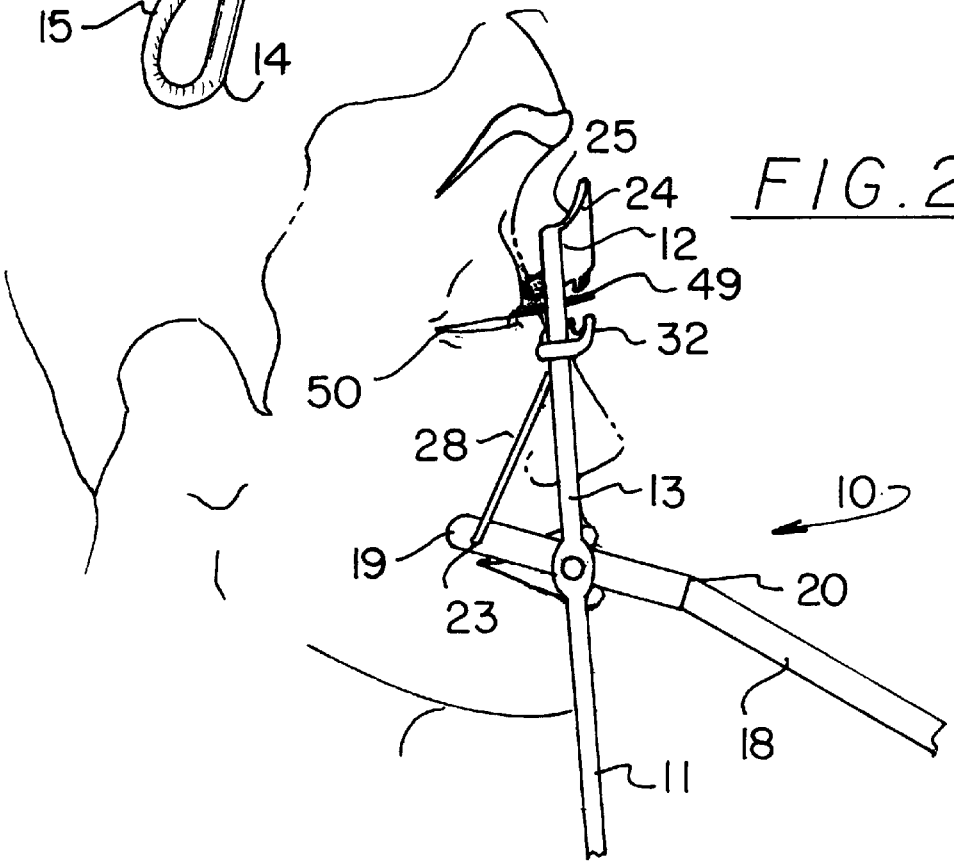
FIG. 2 is a schematic side view of the present invention in use.

With reference now to the drawings, and in particular to FIGS. 1 through 6 thereof, a new combination eyelash curler and eyeliner applicator embodying the principles and concepts of the present invention and generally designated by the reference numeral 10 will be described.

As best illustrated in FIGS. 1 through 4, the combination eyelash curler and eyeliner applicator 10 generally comprises a first handle 11 that has a top end 12, a middle portion 13 and a bottom end 14. The bottom end 14 of the first handle 11 is shaped to form a loop 15. The middle portion 13 of the first handle 11 is split to form a first branch 16 and a second branch 17 in a substantially Y-shaped configuration. The first 16 and second 17 branch form a plane that is oriented substantially perpendicular to the plane formed by the loop 15. The first branch 16 and the second branch 17 are cylindrical in shape and each has a diameter.

The combination eyelash curler and eyeliner applicator 10 also has a second handle 18. The second handle 18 has a top end 19, a middle portion 20 and a bottom end 21. The second handle 18 of the combination eyelash curler and eyeliner applicator 10 has a bend along its length. The bottom end 21 of the second handle 18 is shaped to form a loop 22. The second handle 18 also has a bore 23 located near its top end 19. The middle portion 20 of the second handle 18 is pivotally connected in between the first branch 16 and the second branch 17 of the middle portion 13 of the first handle 11 to form a scissors-like mechanism.

The applicator 10 has an upper applicator portion 24. The upper applicator portion 24 is curved substantially throughout its entire length and has a top side 25, a bottom side 26 and an inside curved portion 27. The upper applicator portion 24 is extended between the first branch 16 and second branch 17 of the top end of the first handle 11.

The applicator 10 also has a lower connecting rod 28 that is substantially V-shaped and has a given diameter. The lower connecting rod 28 has a first end 29 and a second end 30 and a medial apex portion 31 extending through the bore 23 in the top end 19 of the second handle 18.

The applicator 10 has a lower applicator portion 32. The lower applicator portion 32 has a top side 33, a bottom side 34, a first end 35 and a second end 36. The lower applicator portion 32 is curved along its length. The curve of the lower applicator portion 32 is substantially the same as the curve of the upper applicator portion 24. The lower applicator portion 32 has a groove 37 formed on its top side 33 that extends between the first end 35 and the second end 36 of the lower applicator portion 32. The first end 35 of the lower applicator portion 32 has a bore 38 with a diameter slightly larger than the diameter of the first branch 16 of the middle portion 13 of the first handle 11. The second end 36 of the lower applicator portion 32 has a bore 39 with a diameter slightly larger than the diameter of the second branch 17 of the middle portion 13 of the first handle 11. The first branch 16 of the middle portion 13 of the first handle 11 is received in the bore 38 in the first end 35 of the lower applicator portion 32. The second branch 17 of the middle portion 13 of the first handle 11 is received in the bore 39 in the second end 36 of the lower applicator portion 32 in a manner such that the curve of the lower applicator portion 32 aligns with the curve of the upper applicator portion 24.

The bottom side 34 of the lower applicator portion 32 is solidly attached to the first end 29 of the lower connecting rod 28 at a location substantially adjacent to the first end 35 of the lower applicator portion 32. The bottom side 34 of the lower applicator portion 32 is also solidly attached to the second end 30 of the lower connecting rod 28 at a location substantially adjacent to the second end 36 of the lower applicator portion 32. Upon movement of the first 11 and second 18 handle together, the lower applicator portion 32 is moved along the middle portion 13 of the first handle 11 toward the upper applicator portion 24.

Figure 3:
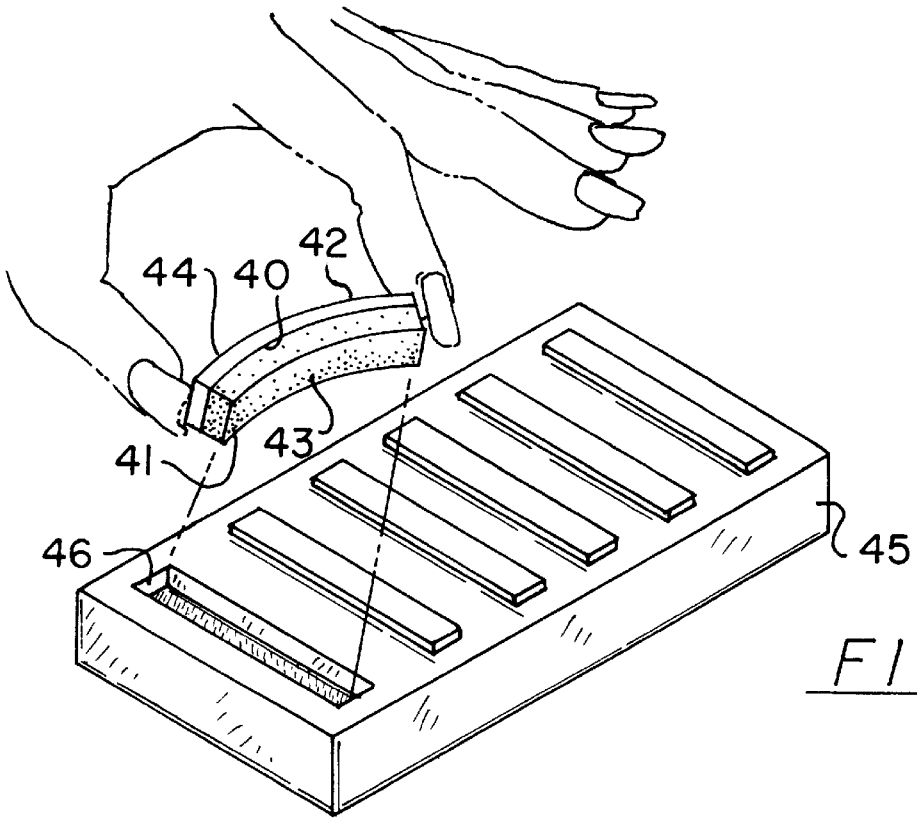
FIG. 3 is a schematic perspective view of the case and the replaceable eyeliner cartridges of the present invention.

The applicator 10 has a plurality of replaceable eyeliner cartridges 40 (see FIG. 3). The replaceable eyeliner cartridges 40 each have a front side 41 and a back side 42. The front side 41 is made of an absorbent material 43 having a length, width and depth. The absorbent material 43 is adapted to absorb an eyeliner color substance and release the substance upon compression of the absorbent material 43. The back side 42 is made of a semi-pliable material 44 having a length, width and depth.

The system also includes a case 45. The case 45 has a plurality of cavities 46 for holding the replaceable eyeliner cartridges 40 having colors of eyeliner. Each of the cavities 46 has a length, width and depth generally corresponding to the front side 41 of one of the eyeliner cartridges 40. The front side 41 of a replaceable eyeliner cartridge 40 fits snuggly into one of the cavities 46 in the case 45 for storage and absorption of color eyeliner.

Figure 4:
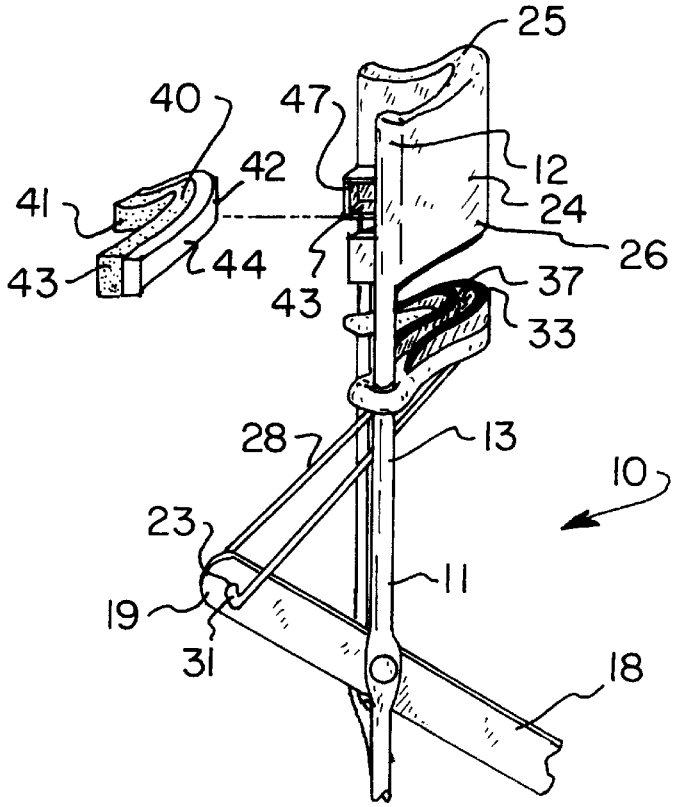
FIG. 4 is a schematic perspective view of the casing on the eyelash curler of the present invention and a replaceable eyeliner cartridge shown exploded away from the casing.

A casing 47 is attached to the inside curved portion 27 of the upper applicator portion 24 at a location substantially adjacent to its bottom side 26 (see FIG. 4). The casing 47 forms a channel 48 having a length substantially similar to the length of the upper applicator portion 24. The casing is curved to approximate the curve of the upper applicator portion 24. The channel 48 of the casing 47 has a depth, width and length generally corresponding to the depth, width and length of the back side 42 of one of the replaceable eyeliner cartridges 40.

The back side 42 of the replaceable eyeliner cartridge 40 fits snuggly into the channel 48 of the casing 47 in such a manner that the absorbent material 43 on the front side 41 of the replaceable eyeliner cartridge 40 protrudes from the channel 48 of the casing 47.

In use, the back side 42 of one of the replaceable eyeliner cartridges 40 is inserted in the channel 48 of the casing 47 on the upper applicator portion 24. The user then simply positions eyelashes 49 in between the upper 24 and lower 32 applicator portions and moves the first 11 and second 18 handles toward each other. The eyelashes 49 then come in contact with the bottom side 26 of the upper applicator portion 24 and are compressed into the groove 37 on the top side 33 of the lower applicator portion 32 thereby curving the eyelashes 49. At the same time the eyelashes 49 are being curved, the absorbent material 43 on the front side 41 of the replaceable eyeliner cartridge 40 comes into contact with the operator's eyelid 50 thereby transferring eyeliner to the operators eyelid 49.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination eyelash curler and eyeliner applicator comprising:

a eyelash curler having an upper applicator portion for applying pressure to an upper side of a user's eyelashes, the upper applicator portion having an inside curved portion and a outside curved portion, the eyelash curler having a lower applicator portion for applying pressure to the lower side of the user's eyelashes, the lower applicator portion being adapted to curve eyelashes about the outside curved portion of the upper applicator portion;

a plurality of replaceable eyeliner cartridges, the replaceable eyeliner cartridges each having a front side and a back side, the front side comprising an absorbent material having a length, width and depth;

a means for removably attaching the back side of each of the replaceable eyeliner cartridge to the inside curved portion of the upper application portion of the eyelash curler, such that the absorbent material is pressed into contact with the user's eyelid when the user's eyelashes are being curled thereby transferring eyeliner to the user's eyelid;

a case having a plurality of cavities for holding a plurality of the replaceable eyeliner cartridges, the cavities having a length, width and depth generally corresponding to the front side of one of the replaceable eyeliner cartridges, wherein the front side of a replaceable eyeliner cartridge fits removably snug into one of the cavities in the case for storage and absorption of color eyeliner.

2. The combination eyelash curler and eyeliner applicator of claim 1 wherein the means for removably attaching the back side of the replaceable eyeliner cartridge to the inside curved portion of the upper application portion of the eyelash curler includes a casing attached to the inside curved portion of the upper applicator portion, the casing forming a channel having a length substantially similar to the length of the upper applicator portion, the casing being curved to approximate the curve of the upper applicator portion, the channel of the casing having a depth and width; and the back side of each of the replaceable eyeliner cartridges being made of a semi-pliable material having a length, width and depth, the length, width and depth of the back side of each of the replaceable eyeliner cartridges generally corresponding to the length, width and depth of the channel of the casing, wherein the back side of the replaceable eyeliner cartridge fits removably snug into the channel of the casing in a manner such that the absorbent material on the front side of the replaceable eyeliner cartridge protrudes from the channel of the casing.

3. The combination eyelash curler and eyeliner applicator of claim 1 further comprising, a first handle having a top end, a middle portion and a bottom end, the bottom end being shaped to form a loop, the middle portion being split to form a first branch and a second branch substantially Y-shaped, the first and second branch forming a plane that is substantially perpendicular to the plane formed by the loop, the first branch and the second branch being cylindrical in shape and each having a diameter; and a second handle having a top end, a middle portion and a bottom end, the second handle having a bend along its length, the bottom end of the second handle being shaped to form a loop, the second handle having a bore of a diameter, the bore being located near the top end of the second handle, the middle portion of the second handle being pivotally connected in between the first branch and the second branch of the middle portion of the first handle to form a scissors like mechanism.

4. The combination eyelash curler and eyeliner applicator of claim 3 wherein the upper applicator portion is extended between the first branch and second branch of the top end of the first handle.

5. The combination eyelash curler and eyeliner applicator of claim 3 wherein the lower applicator portion includes a top side, a bottom side, a first end and a second end, the lower applicator portion being curved along its length, the curve of the lower applicator portion being substantially the same as the curve of the upper applicator portion, the lower applicator portion having a groove formed on its top side and extending in between the first end and the second end of the lower applicator portion, the first end having a bore with a diameter slightly larger than the diameter of the first branch of the middle portion of the first handle, the second end having a bore with a diameter slightly larger than the diameter of the second branch of the middle portion of the first handle, the first branch of the middle portion of the first handle being received in the bore in the first end of the lower applicator portion and the second branch of the middle portion of the first handle being received in the bore in the second end of the lower applicator portion in a manner wherein the curve of the lower applicator portion aligns with the curve of the upper applicator portion.

6. The combination eyelash curler and eyeliner applicator of claim 5 further comprising, a lower connecting rod having a substantially V-shape and having a diameter, the lower connecting rod having a first end and a second end and a medial apex portion extending through the bore in the top end of the second handle, the bottom side of the lower applicator portion being solidly attached to the first end of the lower connecting rod substantially near the first end of the lower applicator portion and to the second end of the lower connecting rod substantially near the second end of the lower applicator portion, wherein upon movement of the first and second handle, the lower applicator portion is moved along the middle portion of the first handle.

7. A combination eyelash curler and eyeliner applicator comprising:

a first handle having a top end, a middle portion and a bottom end, the bottom end being shaped to form a loop, the middle portion being split to form a first branch and a second branch substantially Y-shaped, the first and second branch forming a plane that is substantially perpendicular to the plane formed by the loop, the first branch and the second branch being cylindrical in shape and each having a diameter;

a second handle having a top end, a middle portion and a bottom end, the second handle having a bend along its length, the bottom end of the second handle being shaped to form a loop, the second handle having a bore of a diameter, the bore being located near the top end of the second handle, the middle portion of the second handle being pivotally connected in between the first branch and the second branch of the middle portion of the first handle to form a scissors like mechanism;

an upper applicator portion, the upper applicator portion being curved substantially throughout its length and having a top side, a bottom side and an inside curved portion, the upper applicator portion being extended between the first branch and second branch of the top end of the first handle;

a lower connecting rod having a substantially V-shape and having a diameter, the lower connecting rod having a first end and a second end and a medial apex portion extending through the bore in the top end of the second handle;

a lower applicator portion having a top side, a bottom side, a first end and a second end, the lower applicator portion being curved along its length, the curve of the lower applicator portion being substantially the same as the curve of the upper applicator portion, the lower applicator portion having a groove formed on its top side and extending in between the first end and the second end of the lower applicator portion, the first end having a bore with a diameter slightly larger than the diameter of the first branch of the middle portion of the first handle, the second end having a bore with a diameter slightly larger than the diameter of the second branch of the middle portion of the first handle, the first branch of the middle portion of the first handle being received in the bore in the first end of the lower applicator portion and the second branch of the middle portion of the first handle being received in the bore in the second end of the lower applicator portion in a manner wherein the curve of the lower applicator portion aligns with the curve of the upper applicator portion, the bottom side of the lower applicator portion being solidly attached to the first end of the lower connecting rod substantially near the first end of the lower applicator portion and to the second end of the lower connecting rod substantially near the second end of the lower applicator portion, wherein upon movement of the first and second handle together, the lower applicator portion is moved along the middle portion of the first handle toward the upper applicator portion;

a plurality of replaceable eyeliner cartridges, the replaceable eyeliner cartridges each having a front side and a back side, the front side being made of an absorbent material having a length, width and depth the back side being made of a semi-pliable material having a length, width and depth;

a case having a plurality of cavities for holding different color liquid eyeliner, the cavities having a length, width and depth generally corresponding to the front side of one of the eyeliner cartridges, wherein, the front side of a replaceable eyeliner cartridge fits removably snug into one of the channels in the case for storage and absorption of color liquid eyeliner;

a casing attached to the inside curved portion substantially near the bottom side of the upper applicator portion, the casing forming a channel having a length substantially similar to the length of the upper applicator portion, the casing being curved to approximate the curve of the upper applicator portion, the channel of the casing having a depth and width, the length, width and depth of the channel of the casing generally corresponding to the length, width and depth of the back side of one of the replaceable eyeliner cartridges, wherein the back side of the replaceable eyeliner cartridge fits removably snug into the channel of the casing in such a manner that the absorbent material on the front side of the replaceable eyeliner cartridge protrudes from the channel of the casing;

wherein once the back side of a replaceable eyeliner cartridge is inserted in the channel of the casing on the upper applicator portion, the user simply positions eye lashes in between the upper and lower applicator portions and moves the first and second handles toward each other, the eyelashes then come in contact with the bottom side of the upper applicator portion and are compressed into the groove of the top side of the lower applicator portion thereby curving the eyelashes, at the same time the absorbent material on the front side of the replaceable eyeliner cartridge comes into contact with the operator's eyelid thereby transferring eyeliner to the operators eyelid.

* * * * *